US006656003B1

(12) United States Patent
Kitsu et al.

(10) Patent No.: US 6,656,003 B1
(45) Date of Patent: Dec. 2, 2003

(54) ANTI-VIBRATION SUPPORTING STRUCTURE FOR AN OUTBOARD ENGINE SYSTEM

(75) Inventors: Kunihiro Kitsu, Wako (JP); Tetsuro Ikeno, Wako (JP); Hiroshi Mizuguchi, Wako (JP); Kazuyuki Shiomi, Wako (JP); Taiichi Otobe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/070,445

(22) PCT Filed: Sep. 22, 2000

(86) PCT No.: PCT/JP00/06530

§ 371 (c)(1),
(2), (4) Date: Mar. 20, 2002

(87) PCT Pub. No.: WO01/21481

PCT Pub. Date: Mar. 29, 2001

(30) Foreign Application Priority Data

Sep. 24, 1999 (JP) ..... 11-270879
Sep. 24, 1999 (JP) ..... 11-270880

(51) Int. Cl.[7] ..... B63H 21/30
(52) U.S. Cl. ..... 440/52
(58) Field of Search ..... 440/52, 53, 900; 123/195 P

(56) References Cited

U.S. PATENT DOCUMENTS 4,979,918 A 12/1990 Breckenfeld et al.
5,180,319 A * 1/1993 Shiomi et al. ..... 440/52

FOREIGN PATENT DOCUMENTS

| | | |
|---|---|---|
| JP | 5-278685 | 10/1993 |
| JP | 7-61797 | 7/1995 |
| JP | 2710346 | 10/1997 |
| JP | 2710347 | 10/1997 |
| JP | 2885293 | 2/1999 |
| JP | 2905257 | 3/1999 |
| JP | 11-99990 | 4/1999 |

* cited by examiner

*Primary Examiner*—Ed Swinehart
(74) *Attorney, Agent, or Firm*—Arent Fox Kintner Plotkin & Kahn, PLLC

(57) ABSTRACT

A center frame 64 fixed to a lower end of a swivel shaft 62 of an outboard engine system by a bolt 79 includes a swivel shaft extension $\mathbf{64}_1$ extending downwards from the lower end of the swivel shaft 62, and a core metal $\mathbf{64}_2$ which extends laterally from a lower end of the swivel shaft extension $\mathbf{64}_1$ and has a lower mount rubber 80 integrally baked thereto. The lower mount rubber 80 is restrained on a rear surface of the extension case 42. Thus, the distance between an upper mount rubber mounted at an upper portion of the swivel shaft 62 and the lower mount rubber 80 mounted at a lower portion of the swivel shaft 62 can be increased without downward extension of the swivel shaft 62 itself to enhance the anti-vibration effect, while avoiding an increase in extra weight and an increase in cost.

10 Claims, 12 Drawing Sheets

ANTI-VIBRATION SUPPORTING STRUCTURE FOR AN OUTBOARD ENGINE SYSTEM

FIELD OF THE INVENTION

The present invention relates to an anti-vibration supporting structure for an outboard engine system in which a swivel shaft is laterally swingably supported on a bracket device fixed to a hull, and an outboard engine system body is supported in an anti-vibration manner on the swivel shaft with an elastic rubber interposed therebetween.

BACKGROUND ART

In general, an outboard engine system includes an engine room in which an engine is accommodated, and a case body extending downwards from the engine room to accommodate a drive shaft driven by the engine. The engine room and the case body are supported on a hull by an anti-vibration supporting device using an elastic rubber.

More specifically, there is employed an anti-vibration supporting device having a structure in which outer and inner peripheral surfaces of a pair of cylindrical rigid members disposed coaxially with each other are coupled to each other by elastic rubbers, or a pair of plate-shaped rigid members disposed in an opposed relation to each other are coupled to each other by elastic rubbers, thereby constituting an anti-vibration assembly, wherein inner one of the cylindrical rigid members or one of the plate-shaped rigid members is mounted to a bolt extending in an arm-shape from each frame mounted at an upper and lower locations on a swivel shaft. There is also employed another anti-vibration supporting device having a structure in which an anti-vibration assembly is formed as a single component comprising an interior rigid member (a core metal) and elastic rubbers surrounding a periphery of the interior rigid member, wherein the interior rigid member is fixed to a bolt extending in an arm-shape from each frame mounted at an upper and lower vertical locations on a swivel shaft, and the elastic rubbers are restrained in an engine room or a recess defined in a case body.

However, any of the anti-vibration supporting device suffers from the following problem: The elastic rubber supported on the upper rigid member is disposed in the vicinity of an upper end of the swivel shaft, and the elastic rubber supported on the lower rigid member is disposed in the vicinity of a lower end of the swivel shaft. For this reason, in order to increase the distance between the upper and lower elastic rubbers to enhance the anti-vibration effect, it is necessary to increase the length of the swivel shaft, resulting in increases in weight and cost.

In addition, any of the anti-vibration supporting device also suffers from a problem that a component or a structure (a nut threadedly fitted over the bolt, or a working space for operating the nut) is required for fixing the rigid members of the anti-vibration assembly to the bolt extending from the frame and hence, the anti-vibration supporting device is correspondingly complicated and increased in size, and the cost is increased.

DISCLOSURE OF THE INVENTION

The present invention has been accomplished with such circumstances in view, and it is a first object of the present invention to ensure that the distance between the upper and lower elastic rubbers on the swivel shaft is increased without extension of the length of the swivel shaft itself of the outboard engine system, thereby enhancing the anti-vibration effect.

It is a second object of the present invention to provide an anti-vibration supporting structure for an outboard engine system, which is simple in structure, small-sized and inexpensive in cost.

To achieve the first object, according to a first aspect and feature of the present invention, there is provided an anti-vibration supporting structure for an outboard engine system in which a swivel shaft is laterally swingably supported on a bracket device fixed to a hull, and an outboard engine system body is supported in an anti-vibration manner on an upper rigid member coupled to an upper end of the swivel shaft and a lower rigid member coupled to a lower end of the swivel shaft with elastic rubbers interposed therebetween, respectively, characterized in that the lower rigid member includes a swivel shaft extension extending downwards from the lower end of the swivel shaft, and elastic rubber support portions extending laterally from the lower end of the swivel shaft extension for supporting the elastic rubbers.

With the above arrangement, the outboard engine system body is supported at its lower portion in the anti-vibration manner by the lower rigid member having the elastic rubber support portion provided at the lower end of the swivel shaft extension extending downwards from the lower end of the swivel shaft. Therefore, the distance between the upper and lower elastic rubbers can be increased without downward extension of the swivel shaft itself to enhance the anti-vibration effect, while avoiding an increase in extra weight and an increase in cost. In addition, the elastic rubbers are supported on the elastic rubber support portions extending laterally from the lower end of the swivel shaft extension. Therefore, the distance between the left and right elastic rubbers can be decreased without interference with the swivel shaft to avoid a reduction in anti-vibration effect.

An oil case 41 and an extension case 42 in embodiments correspond to an outboard engine system body of the present invention. A mounting bracket 55 in the embodiments corresponds to the bracket device of the present invention, and a mount frame 63 in the embodiments corresponds to the upper rigid member of the present invention. A center frame 64 in the embodiments corresponds to the lower rigid member of the present invention, and a core metal $\mathbf{64}_2$ in the embodiments corresponds to the elastic rubber support portion of the present invention. An upper mount rubber 74 and a lower mount rubber 80 in the embodiments correspond to the elastic rubbers of the present invention.

To achieve the second object, according to the present invention, there is provided an anti-vibration supporting structure for an outboard engine system in which a swivel shaft is laterally swingably supported on a bracket device fixed to a hull, and an outboard engine system body is supported in an anti-vibration manner on the swivel shaft with elastic rubbers interposed therebetween, characterized in that the elastic rubbers are integrally provided around tip ends of the rigid member extending laterally from the swivel shaft, and are restrained in elastic rubber restraining portions provided in the outboard engine system body.

With the above arrangement, the elastic rubbers integrally provided around the tip ends of the rigid member extending laterally from the swivel shaft are restrained in elastic rubber restraining portions provided in the outboard engine system body and hence, a component or a working space for fixing the elastic rubbers to the rigid member is not required, whereby the structure of the anti-vibration supporting device for the outboard engine system can be simplified, contributing to reductions in size and cost.

An extension case 42 in the embodiments corresponds to the outboard engine system body of the present invention, and a rubber accommodating portion $\mathbf{42}_2$ and a cover member 81 in the embodiments correspond to the elastic rubber restraining portion of the present invention. A center frame 64 in the embodiments corresponds to the rigid member of the present invention, and a lower mount rubber 80 in the embodiments corresponds to the elastic rubber of the present invention.

BRIEF DESCRIPTION OF THE DRAWINGS

FIGS. 1 to 10 show a first embodiment of the present invention, wherein FIG. 1 is a side view of the entire arrangement of an outboard engine system;

FIG. 2 is an enlarged sectional view of an essential portion shown in FIG. 1;

FIG. 3 is a sectional view taken along a line 3—3 in FIG. 2;

FIG. 4 is an enlarged view of the essential portion shown in FIG. 1;

FIG. 5 is a sectional view taken along a line 5—5 in FIG. 4;

FIG. 6 is a sectional view taken along a line 6—6 in FIG. 2;

FIG. 7 is an enlarged sectional view of an essential portion shown in FIG. 5;

FIG. 8 is an enlarged sectional view of the essential portion shown in FIG. 5;

FIG. 9 is a view taken in the direction of an arrow 9 in FIG. 8;

FIG. 10 is a sectional view taken along a line 10—10 in FIG. 8.

FIGS. 11 and 12 show a second embodiment of the present invention, wherein FIG. 11 is a view similar to FIG. 8; and FIG. 12 is a view taken in the direction of an arrow 12 in FIG. 11.

BEST MODE FOR CARRYING OUT THE INVENTION

A first embodiment of the present invention will now be described with reference to FIGS. 1 to 10.

Figure 1:
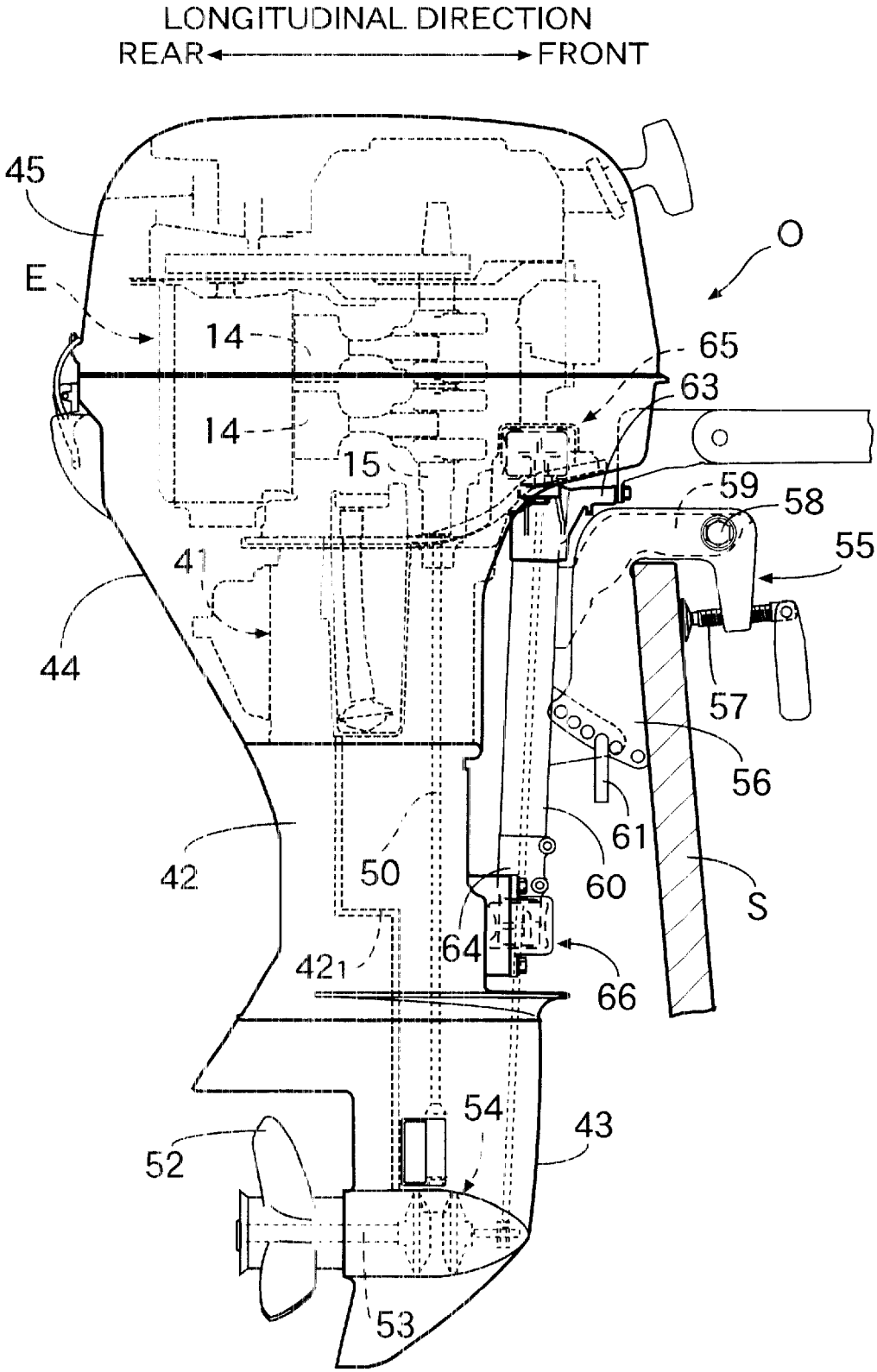
Figure 2:
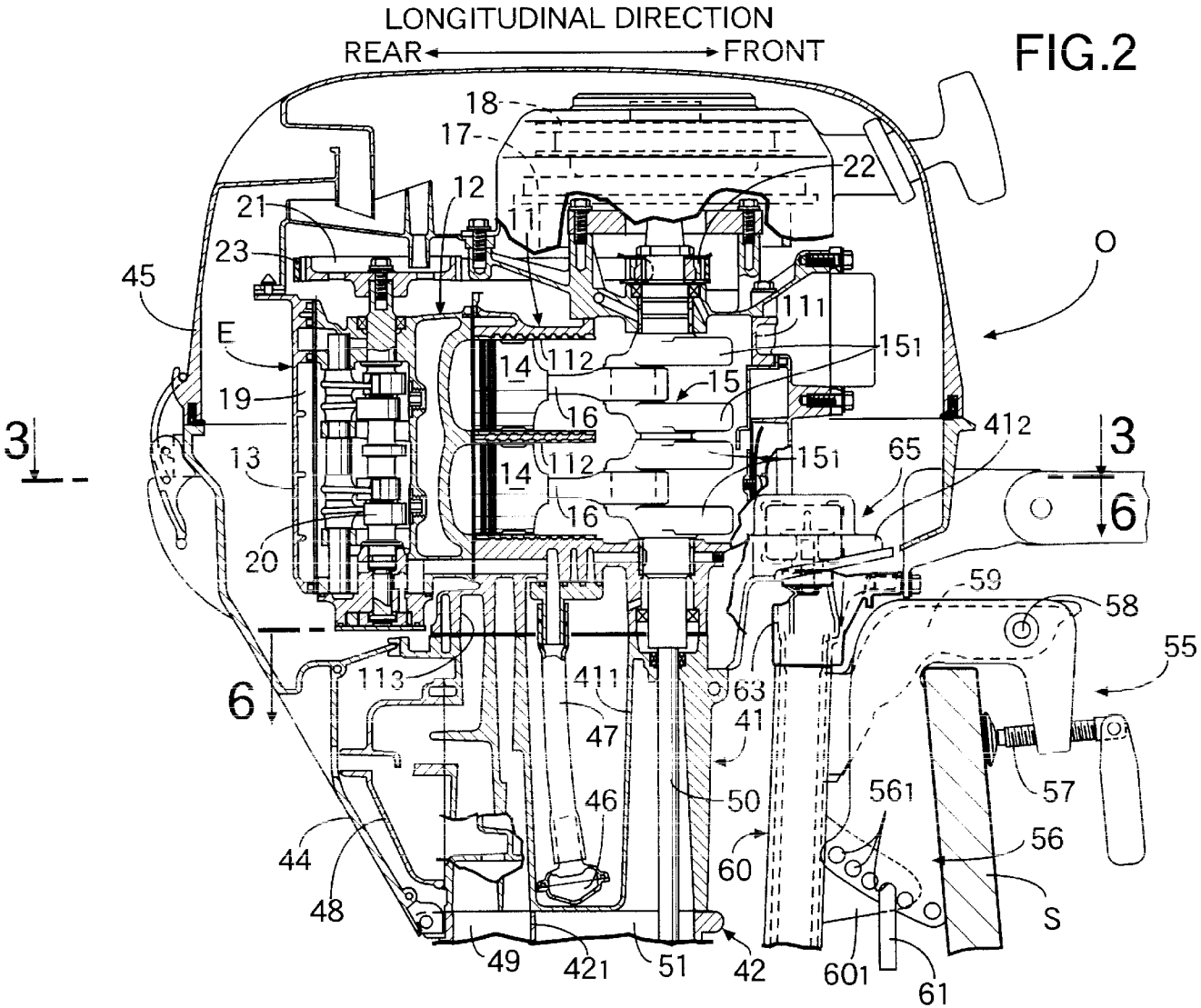
Figure 3:
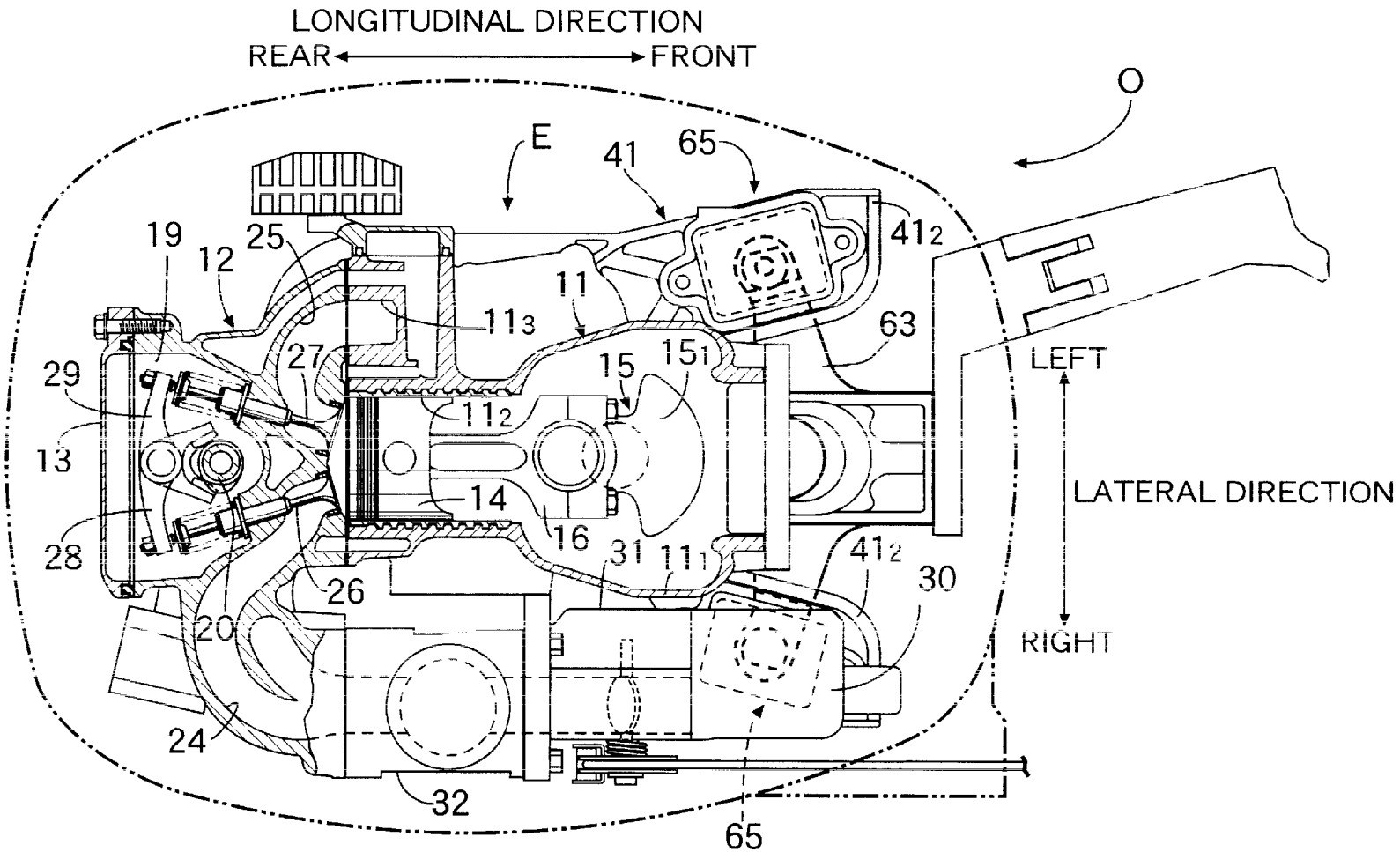

As shown in FIGS. 1 to 3, a two-cylinder and 4-cycle engine E mounted at an upper portion of an outboard engine system O includes an engine block 11 integrally provided with a crankcase $\mathbf{11}_1$, a cylinder head 12 coupled to the engine block 11, and a head cover 13 coupled to the cylinder head 12. Two pistons 14, 14 slidably received in two cylinder bores $\mathbf{11}_2$, $\mathbf{11}_2$ defined in the engine block 11 are connected to a crankshaft 15 supported in the engine block 11 through connecting rods 16, 16, respectively.

A power generator 17 and a recoiled stator 18 are coaxially mounted at an end of the crankshaft 15 protruding upwards from the engine block 11. A camshaft 20 is supported in a valve operating chamber 19 defined between the cylinder head 12 and the head cover 13, and a cam pulley 21 mounted at an upper end of the camshaft 20 and a crank pulley 22 mounted at an upper portion of the crankshaft 15 are connected to each other by a timing belt 23. An intake valve 26 and an exhaust valve 27 for respectively opening and closing an intake port 24 and an exhaust port 25 defined in the cylinder head 12 are connected to the camshaft 20 through an intake rocker arm 28 and an exhaust rocker arm 29, respectively. An intake silencer 30, a choke valve 31 and a variable venturi-type carburetor 32 are disposed on a right side of the engine E and connected to the intake port 24.

An axis of the crankshaft 15 is disposed vertically, and axes of the cylinder bore $\mathbf{11}_2$, $\mathbf{11}_2$ are disposed in a longitudinal direction of an outboard engine system O, so that a side adjacent the crankcase $\mathbf{11}_1$ faces forwards, and a side adjacent the cylinder head 12 faces rearwards. The crank phases of the two pistons 14, 14 are the same as each other, and the timings of ignition provided by the pistons 14, 14 are displaced from each other through 360°. Counterweights $\mathbf{15}_1$ are mounted on the crankshaft 15 and have a balance rate of 100% for countering the mass of reciprocal movement of the pistons 14, 14. Therefore, a longitudinal primary vibration caused by the reciprocal movement of the pistons 14, 14 is countervailed by a rotating movement of the counterweights $\mathbf{15}_1$ of the crankshaft 15.

An upper surface of an oil case 41 is coupled to a lower surface of the engine E having the above-described structure. An upper surface of an extension case 42 is coupled to a lower surface of the oil case 41, and an upper surface of a gear case 43 is coupled to a lower surface of the extension case 42. An outer periphery of the oil case 41 and an outer periphery of lower half of the engine E are covered with an undercover 44 coupled to an upper end of the extension case 42, and upper half of the engine E is covered with an engine cover 45 coupled to an upper end of the undercover 44.

The oil case 41 is integrally provided with an oil pan $\mathbf{41}_1$, and a suction pipe 47 including an oil strainer 46 is accommodated within the oil pan $\mathbf{41}_1$. An exhaust passage defining member 48 is coupled to a rear surface of the oil case 41, and an exhaust gas expanding chamber 49 is defined in the extension case 42 with a partition wall $\mathbf{42}_1$ formed therebetween. An exhaust gas exiting from the exhaust port 25 is supplied through an exhaust passage $\mathbf{11}_3$ defined in the engine block 11 into the exhaust gas passage defining member 48; then passed through the exhaust gas expanding chamber 49 in the extension case 42, the inside of the gear case 43 and a hollow portion around a propeller shaft 53 which will be described hereinafter, and then discharged into the outside water.

A drive shaft 50 connected to a lower end of the crankshaft 15 extends through the oil case 41 and downwards within a drive shaft chamber 51 defined in the extension case 42, and is connected through a forward/backward movement switchover mechanism 54 to a front end of the propeller shaft 53, which is supported longitudinally in the gear case 43 and has a propeller 52 at its rear end.

Figure 4:
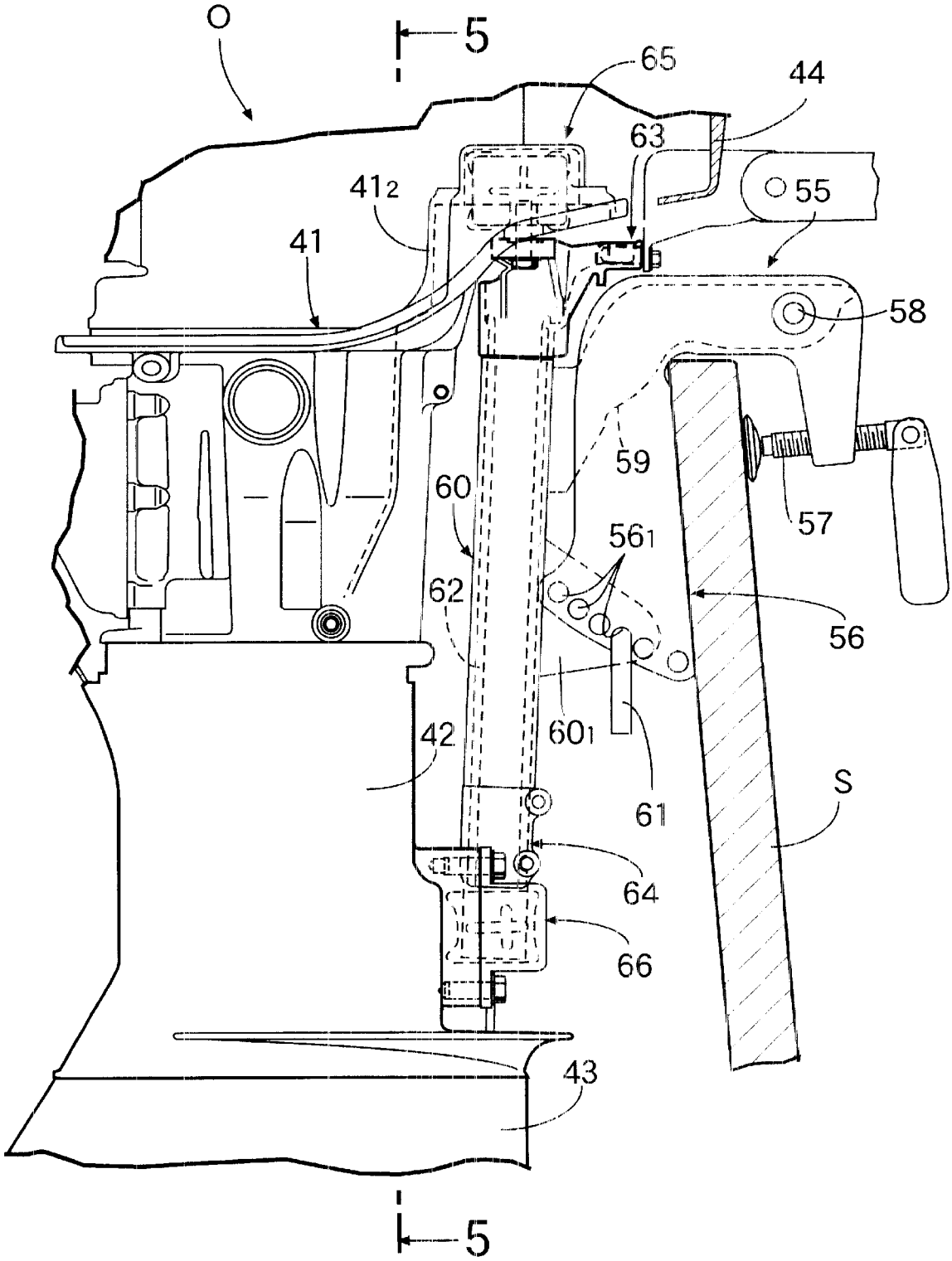
Figure 5:
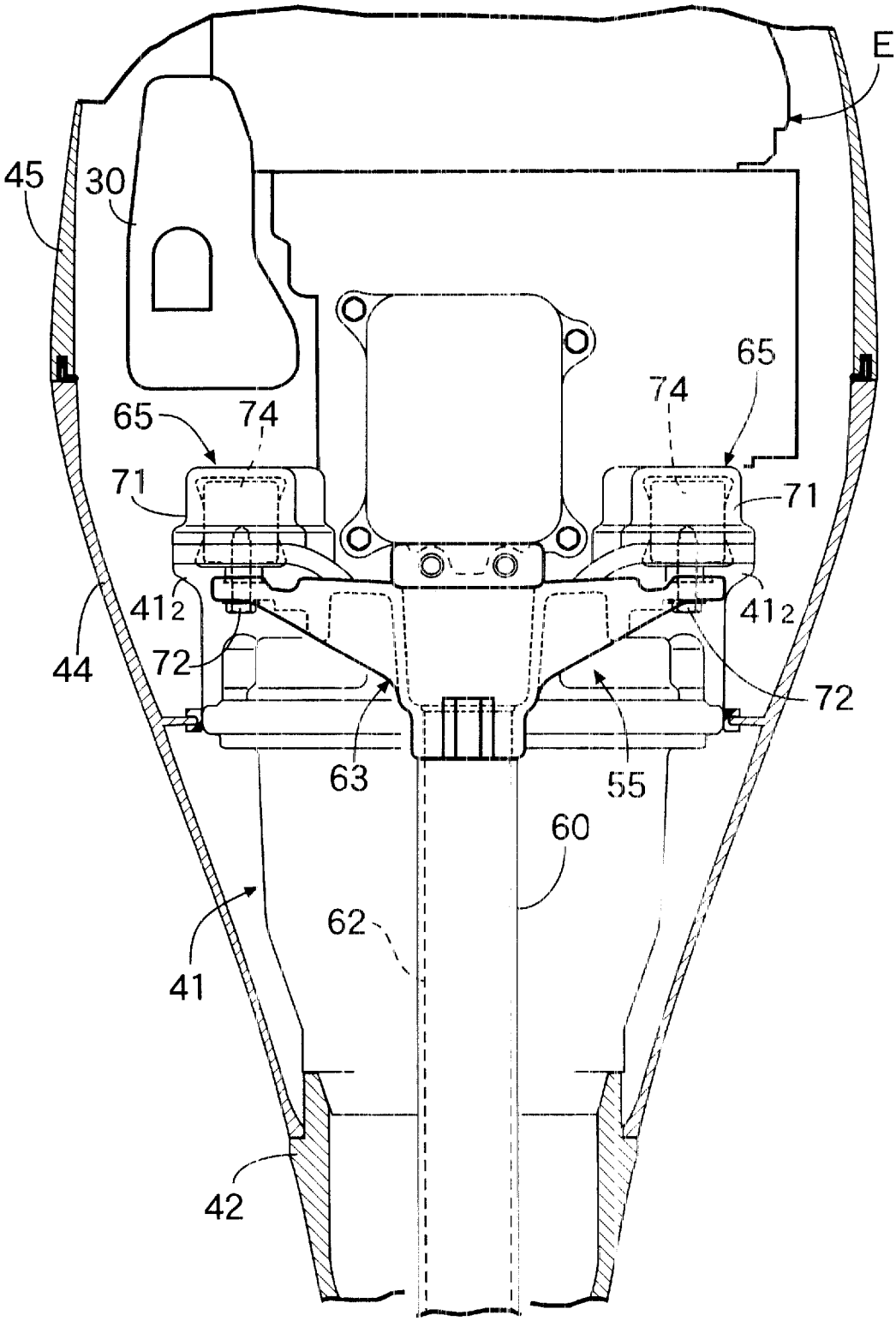

As can be seen from FIGS. 4 and 5, a mounting bracket 55 for detachably mounting the outboard engine system O to a hull S includes an inversed J-shaped mounting bracket body 56, and a setscrew 57 threadedly fitted in the mounting bracket body 56. A swinging arm 59 is pivotally supported at its front end on the mounting bracket body 56 through a pivot pin 58, and a swivel case 60 having a cylindrical portion extending vertically is integrally coupled to a rear end of the swinging arm 59. A large number of pinholes $\mathbf{56}_1$ are provided in the mounting bracket body 56, so that the tilting angle of the outboard engine system O about the pivot pin 58 can be regulated by inserting a pin 61 through a pinhole defined in a locking plate $\mathbf{60}_1$ fixed to the swivel case 60 and through any of the pinholes $\mathbf{56}_1$ in the mounting bracket body 56.

The outboard engine system O includes upper mounts 65, 65 and a lower mount 66 respectively at upper and lower ends of a swivel shaft 62 relatively rotatably fitted in the swivel case 60. Thus, the outboard engine system O is supported in an anti-vibration manner on the hull S by the upper mounts 65, 65 and the lower mount 66.

More specifically, a rigid mount frame 63 is mounted at an upper end of the swivel shaft 62 to extend laterally from the center of the swivel shaft 62, and upper mount rubbers 74, 74, each of which is an elastomer, are mounted at left and right ends of the mount frame 63, respectively. A rigid center frame 64 is mounted at a lower end of the swivel shaft 62 to extend laterally from the center of the swivel shaft 62, and lower mount rubbers 80, 80, each of which is an elastomer, are mounted at left and right ends of the center frame 64. The oil case 41 serving as an engine support block and the extension case 42 fastened to the oil case 41 restrain the upper mount rubber 74, 74 and the lower mount rubbers 80, 80, whereby the outboard engine system O is supported on the hull S in the anti-vibration manner.

Figure 6:
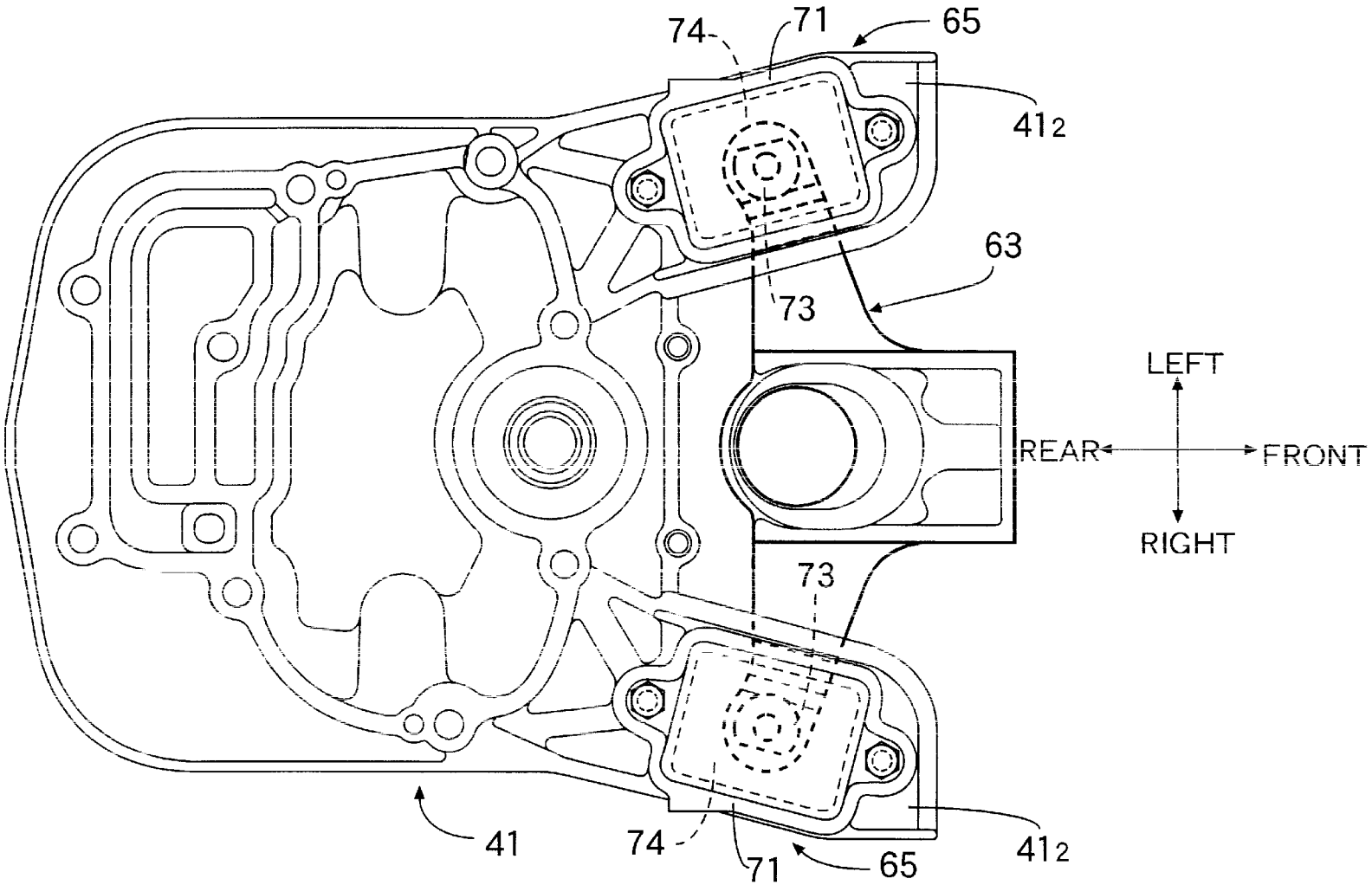
Figure 7:
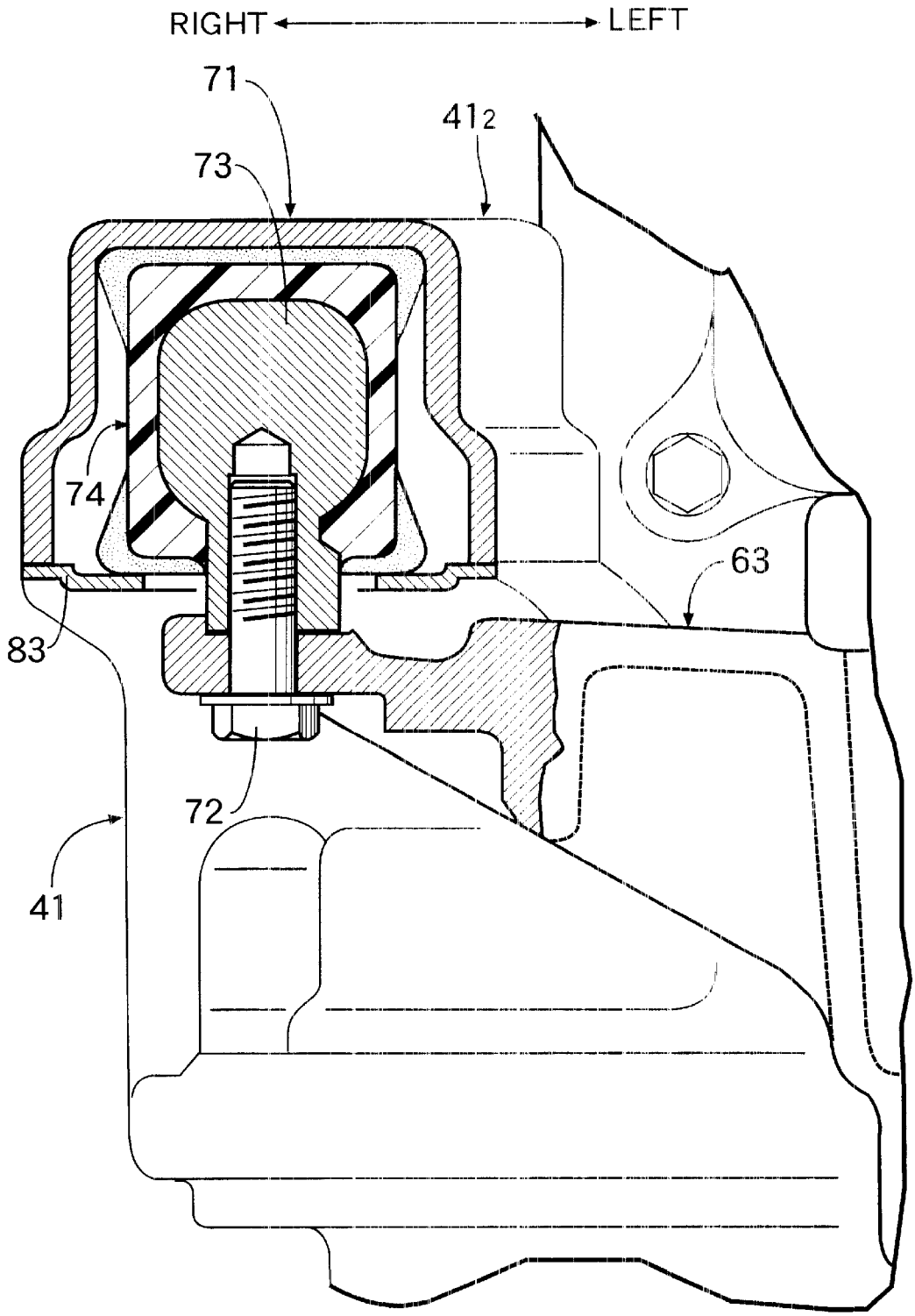

The structure of each of the upper mounts 65, 65 will be described below with reference to FIGS. 5 to 7.

The oil case 41 includes a pair of left and right protrusions $\mathbf{41}_2$, $\mathbf{41}_2$ overhanging forwards and upwards. The protrusions $\mathbf{41}_2$, $\mathbf{41}_2$ are formed with rubber-accommodating portions 71, 71 with their lower surfaces opened, respectively. On the other hand, substantially rectangular parallelepipedic upper mount rubbers 74, 74 are mounted at left and right ends of the mount frame 63 to cover peripheries of core metals 73, 73 fixed by bots 72, 72, respectively. The upper mount rubbers 74, 74 are fitted into the rubber accommodating portions 71, 71 of the oil case 41 from the below. Restraining cover members 83, 83 are fixed to openings in the lower surface of the rubber accommodating portions 71, 71 by bolts (not shown), so that the upper mount rubbers 74, 74 are prevented from falling out of the rubber accommodating portions 71, 71.

Figure 8:
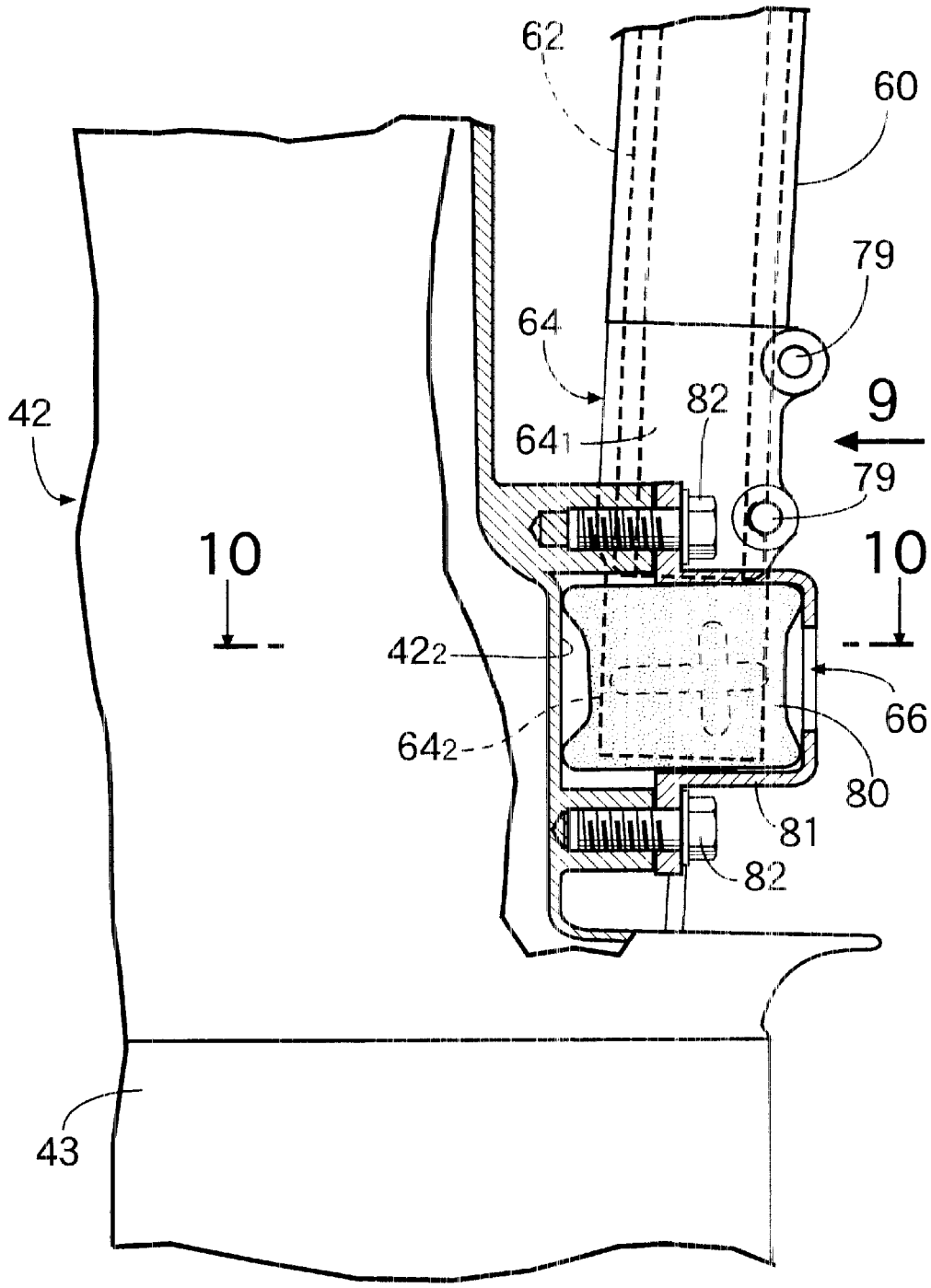
Figure 9:
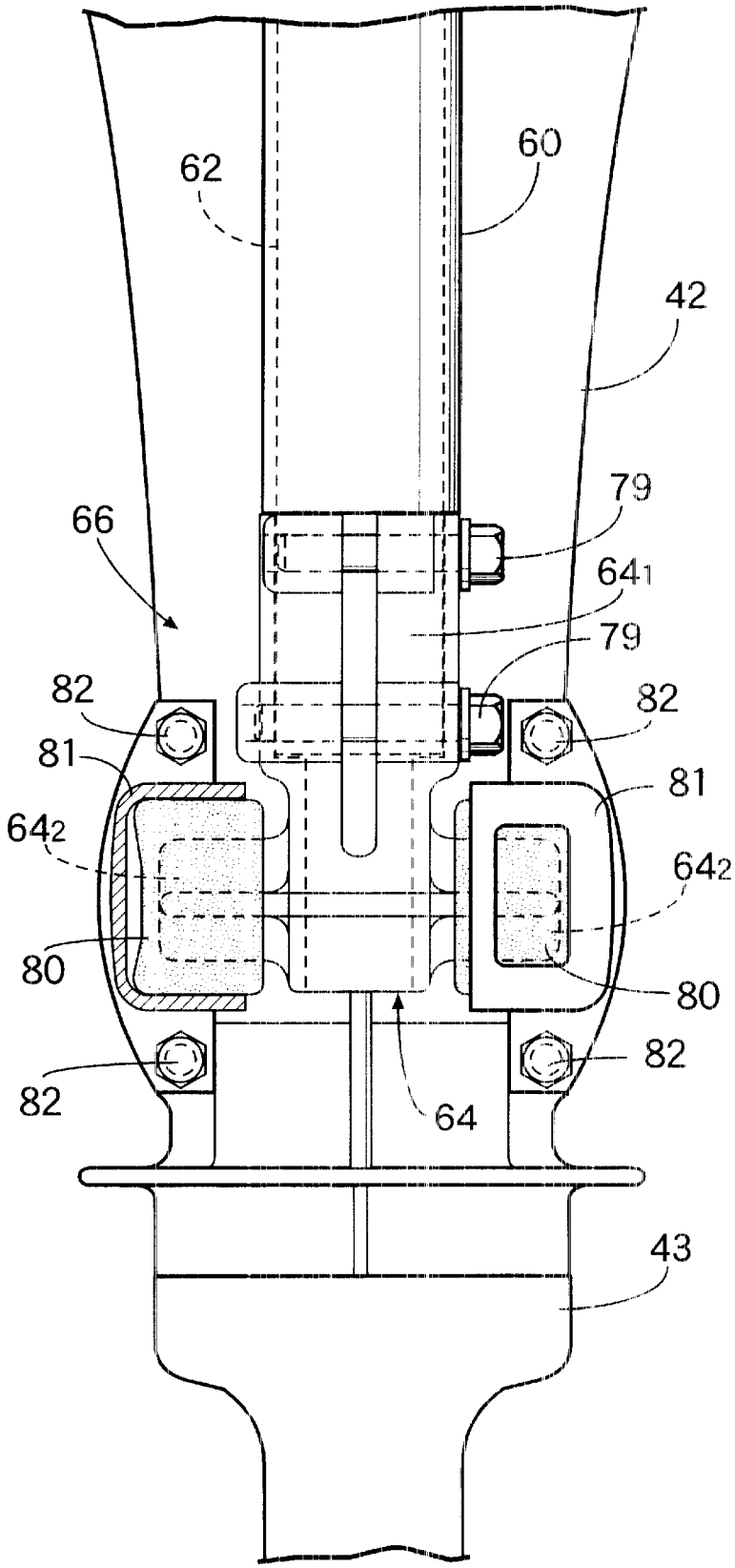
Figure 10:
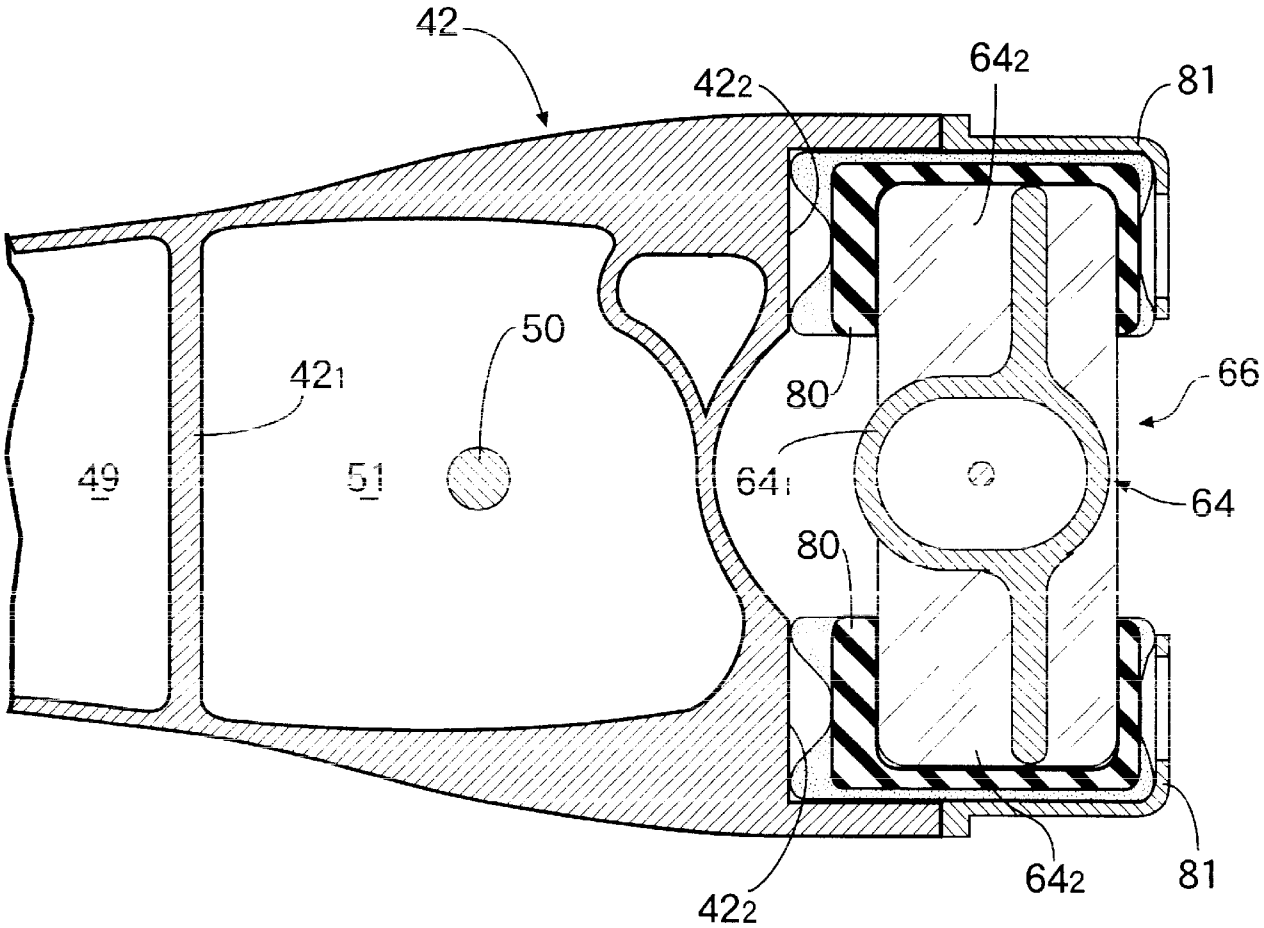

The structure of the lower mount 66 will be described below with reference to FIGS. 8 to 10.

The center frame 64 coupled to the lower end of the swivel shaft 62 protruding downwards from the swivel case 60 is integrally provided with a swivel shaft extension $\mathbf{64}_1$ spline-fitted into and fixed to the swivel shaft 62 by two bolts 79, 79, and a pair of core metals $\mathbf{64}_2$, $\mathbf{64}_2$ protruding laterally from a lower end of the swivel shaft extension $\mathbf{64}_1$ having a reduced lateral width. The lower mount rubbers 80, 80 are fixed by baking to cover outer peripheries of the core metals $\mathbf{64}_2$, $\mathbf{64}_2$. A pair of left and right rubber accommodating portions $\mathbf{42}_2$, $\mathbf{42}_2$ are formed at a rear surface of a lower end of the extension case 42, and a pair of left and right cover members 81, 81 are fastened to the extension case 42 by bolts 82, 82, respectively to restrain the lower mount rubbers 80, 80 fitted into the rubber accommodating portions $\mathbf{42}_2$, $\mathbf{42}_2$ from the rear. Thus, the lower end of the extension case 42 is resiliently supported at the lower end of the swivel shaft 62 through the lower mount 66 provided with the lower mount rubbers 80, 80.

In this manner, the lower mount rubbers 80, 80 are fixed by baking to cover outer peripheries of tip ends of the center frame 64, which extends downwards from the lower end of the swivel shaft 62 and diverges laterally. Therefore, parts such as bolts and nuts for fixing the lower mount rubbers 80, 80 to the center frame 64 are not required, and moreover, a working space for operating such bolts and nuts is not required, whereby the structure of the lower mount 66 is simplified, which contributes to reductions in size and cost of the outboard engine system O.

In addition, the vertically long center frame 64 is coupled to the lower end of the swivel shaft 62, and the lower mount rubbers 80, 80 are mounted at the lower end of the center frame 64. Therefore, the lower mount rubbers 80, 80 can be disposed at low locations without special extension of the swivel shaft 62 itself. Thus, the distance between the upper mount rubbers 74, 74 and the lower mount rubbers 80, 80 can be increased to enhance the anti-vibration effect, while avoiding an increase in extra weight and an increase in cost. Moreover, the lower end of the swivel shaft extension $\mathbf{64}_1$ of the center frame 64 is formed at a decreased width, and the pair of core metals $\mathbf{64}_2$, $\mathbf{64}_2$ are mounted to protrude laterally from the portion of the decreased width. Therefore, the distance between the left and right lower mount rubbers 80, 80 supported on the core metals $\mathbf{64}_2$, $\mathbf{64}_2$ can be decreased without interference with the swivel shaft to avoid a reduction in anti-vibration effect.

Figure 11:
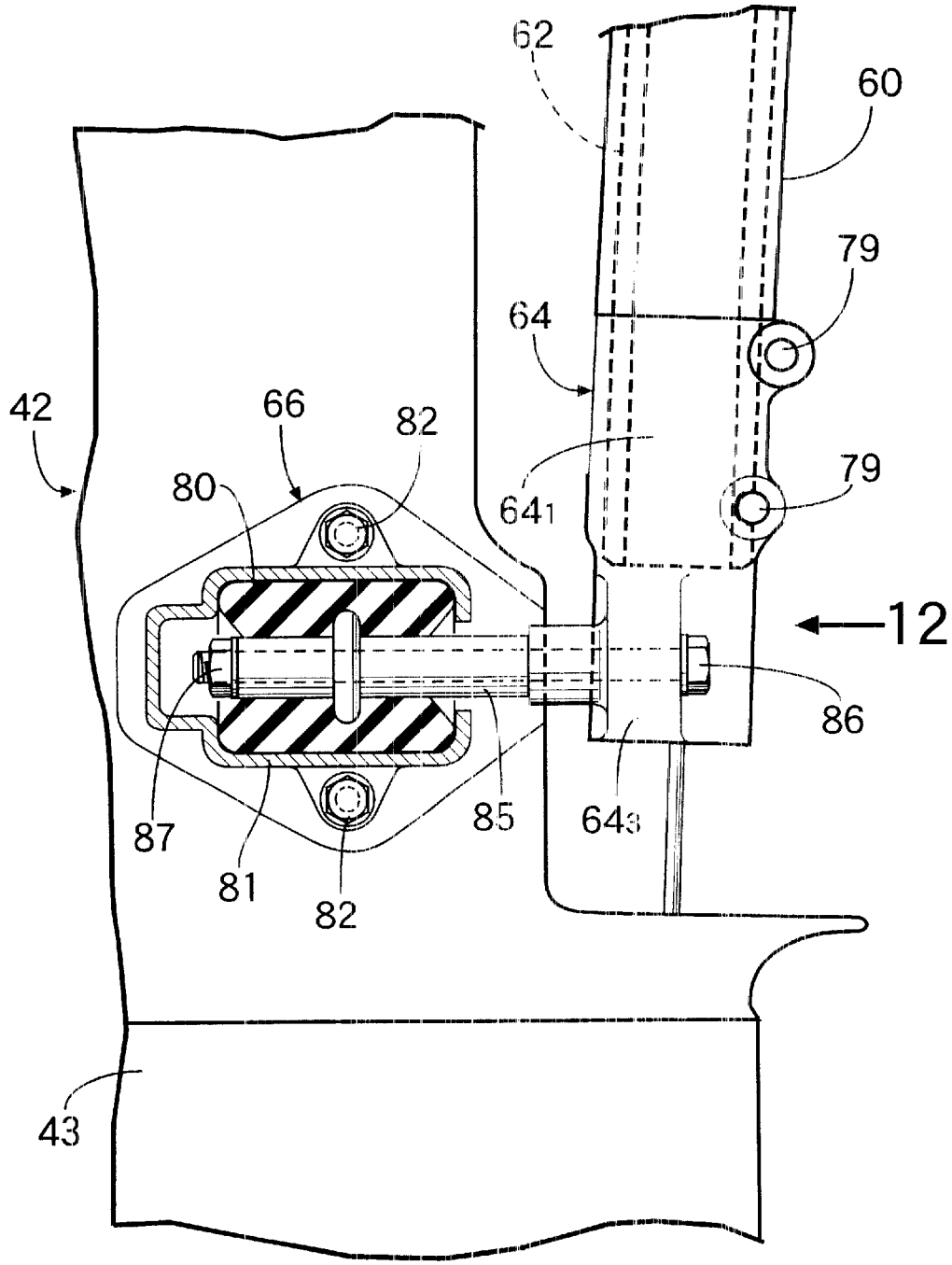
Figure 12:
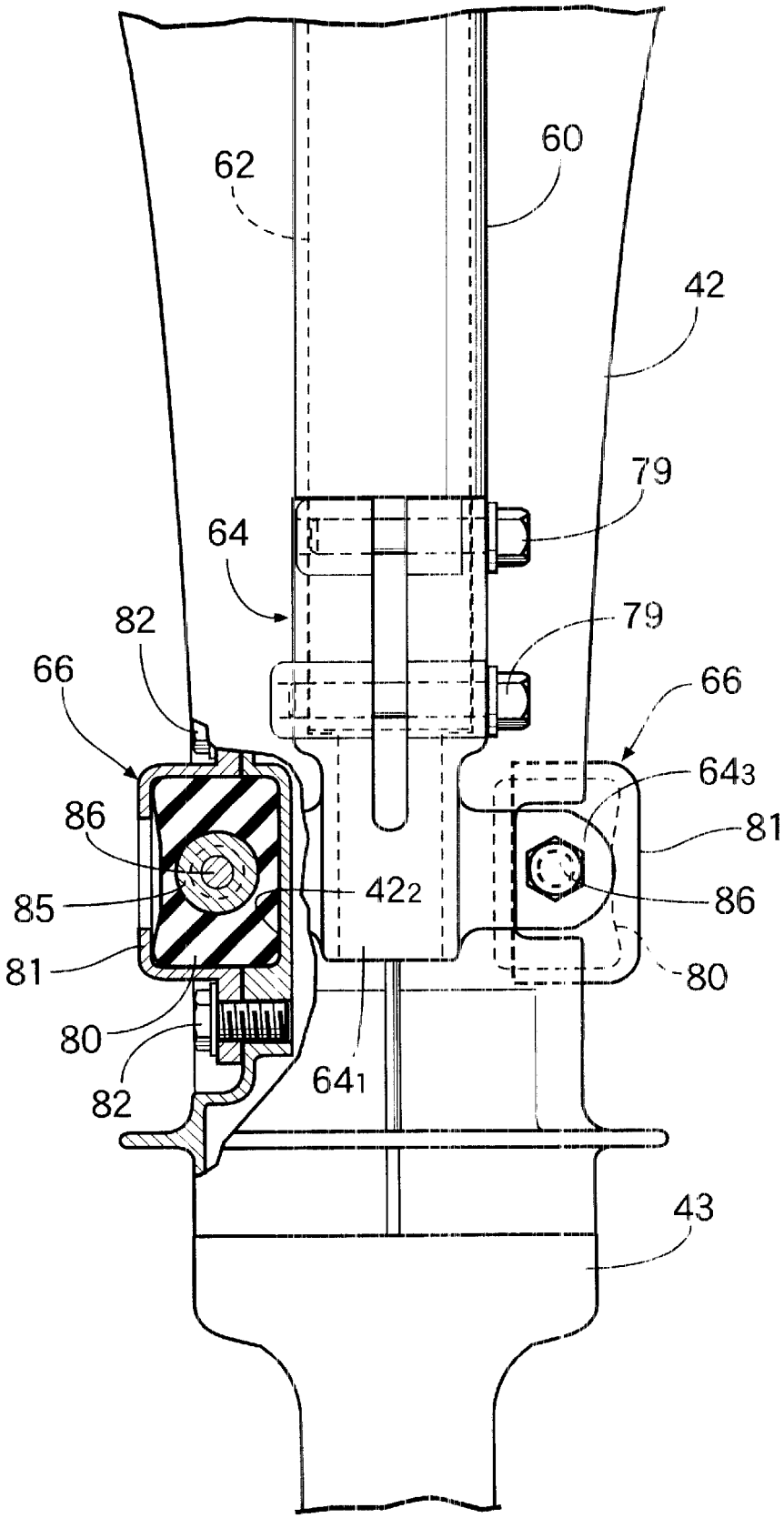

A second embodiment of the present invention will now be described with reference to FIGS. 11 and 12.

The second embodiment includes a pair of left and right lower mounts 66, 66 at the lower portion of the extension case 42. Each of the lower mounts 66 includes a rubber accommodating portion $\mathbf{42}_2$ provided in a recessed manner in a side of the extension case 42. A lower mount rubber 80 fitted in the rubber accommodating portion $\mathbf{42}_2$ is restrained by a cover member 81 fixed to the extension case 42 by two bolts 82, 82. A pipe-shaped core metal 85 is fixed by baking to the center of the lower mount rubber 80, and passed loosely through an opening defined between mating surfaces of the rubber accommodating portion $\mathbf{42}_2$ and the cover member 81 to protrude forwards.

On the other hand, the center frame 64 coupled to the lower end of the swivel shaft 62 by two bolts 79, 79 includes a swivel shaft extension $\mathbf{64}_1$ extending downwards from the lower end of the swivel shaft 62, and a pair of supporting arms $\mathbf{64}_3$, $\mathbf{64}_3$ protruding laterally from a lower end of the swivel shaft extension $\mathbf{64}_1$. The extension case 42 is supported on the center frame 64 with the lower mount rubbers 80, 80 interposed therebetween by tightening, by nuts 87, 87, bolts 86, 86 passed from the front to the rear through the left and right supporting arms $\mathbf{64}_3$, $\mathbf{64}_3$ and the core metals 85, 85 of the left and right lower mount rubbers 80, 80.

Even in the second embodiment, the lower end of the center frame 64 coupled to the lower end of the swivel shaft 62 is connected to the lower mount rubbers 80, 80 through the core metals 85, 85 and hence, the lower mount rubbers 80, 80 can be disposed at low locations without special extension of the swivel shaft 62 itself, and the distance between the upper mount rubbers 74, 74 and the lower mount rubbers 80, 80 can be increased to enhance the anti-vibration effect, while avoiding an increase in extra weight and an increase in cost. In addition, the left and right supporting arms $\mathbf{64}_3$, $\mathbf{64}_3$ are provided to protrude from the lower end of the swivel shaft extension $\mathbf{64}_1$ of the center frame 64 and hence, the distance between the left and right lower mount rubbers 80, 80 can be decreased without interference with the swivel shaft 62 to avoid a reduction in anti-vibration effect.

Although the embodiments of the present invention have been described in detail, it will be understood that the present invention is not limited to the above-described embodiments, and various modifications in design may be made without departing from the subject matter of the invention.

For example, in the first embodiment, the lower mount rubbers 80, 80 are baked and fixed directly to the core metals $\mathbf{64}_2$, $\mathbf{64}_2$ protruding laterally from the swivel shaft extension $\mathbf{64}_1$. In the second embodiment, the core metals 85, 85 integral with the lower mount rubbers 80, 80 are fixed by the bolts 86, 86 and the nuts 87, 87 to the supporting arms $\mathbf{64}_3$, $\mathbf{64}_3$ protruding laterally from the swivel shaft extension $\mathbf{64}_1$. Namely, the center frame 64 may be connected directly or indirectly to the lower mount rubbers 80, 80.

A mode in which the left and right supporting arms $\mathbf{64}_3$, $\mathbf{64}_3$ of the center frame 64 are connected indirectly to the lower mount rubbers 80, 80, includes a mode in which outer and inner peripheral surfaces of a pair of cylindrical rigid members disposed coaxially are coupled to each other by an elastic rubber, and the inner cylindrical rigid member is fixed to the supporting arms $\mathbf{64}_3$, $\mathbf{64}_3$ by bolts, or a mode in which a pair of plate-shaped rigid members disposed in an opposed relation to each other are coupled to each other by an elastic rubber, and one of the plate-shaped rigid members is fixed to the supporting arms $\mathbf{64}_3$, $\mathbf{64}_3$ by bolts.

In addition, in the embodiments, the present invention is applied to the lower mount 66, but in claim 2, the present invention is also applicable to an upper mount.

INDUSTRIAL APPLICABILITY

As discussed above, the anti-vibration supporting structure for the outboard engine system according to the present invention can be applied to an outboard engine in which an outboard engine system body is supported on a swivel shaft laterally swingably supported on a bracket device with an elastic rubber interposed therebetween.

What is claimed is:

1. An anti-vibration supporting structure for an outboard engine system in which a swivel shaft is laterally swingably supported on a bracket device fixed to a hull, and an outboard engine system body is supported in an anti-vibration manner on an upper rigid member coupled to an upper end of said swivel shaft and a lower rigid member coupled to a lower end of said swivel shaft with elastic rubbers interposed therebetween, respectively, characterized in that said lower rigid member includes a swivel shaft extension extending downwards from the lower end of said swivel shaft, and elastic rubber support portions extending laterally from the lower end of said swivel shaft extension for supporting said elastic rubbers.

2. An anti-vibration supporting structure for an outboard engine system according to claim 1, wherein the outboard engine system body includes an oil case having a pair of left and right protrusions, each protrusion having cup shaped rubber-accommodating portion with an open end facing toward the lower rigid member.

3. An anti-vibration supporting structure for an outboard engine system according to claim 2, wherein an upper mount rubber is fitted within a respective cup shaped rubber-accommodating portion through the open end, and wherein the upper rubber mount covers a corresponding core metal that is fixed to the upper rigid member.

4. An anti-vibration supporting structure for an outboard engine system according to claim 3, wherein a restraining cover is fixed to the open end of each rubber-accommodating portion.

5. An anti-vibration supporting structure for an outboard engine system according to claim 1, wherein the swivel shaft extension is spline-fitted into and fixed to the swivel shaft.

6. An anti-vibration supporting structure for an outboard engine system according to claim 5, wherein a pair of core metal extensions protrude laterally from the lower end of the swivel shaft extension.

7. An anti-vibration supporting structure for an outboard engine system according to claim 6, wherein the elastic rubbers are integrally fixed to cover outer periphery of each core metal extension.

8. An anti-vibration supporting structure for an outboard engine system according to claim 7, wherein the elastic rubbers are integrally fixed to the outer periphery of each core metal extension by baking.

9. An anti-vibration supporting structure for an outboard engine system according to claim 7, wherein each elastic rubber is fitted into a corresponding rubber accomodating portion and retained therein by a cover member fastened to an case of extension the outboard engine system body.

10. An anti-vibration supporting structure for an outboard engine system in which a swivel shaft is laterally swingably supported on a bracket device fixed to a hull, and an outboard engine system body is supported in an anti-vibration manner on said swivel shaft with elastic rubbers interposed therebetween, wherein a rigid member is coupled to a lower end of said swivel shaft and comprises a pair of portions which extend laterally and in opposite directions relative to each other, and said elastic rubbers are integrally provided around tip ends of said laterally extending portions of the rigid member and are restrained in elastic rubber restraining portions provided in said outboard engine system body.

* * * * *